US005241788A

United States Patent [19]

Buie

[11] Patent Number: 5,241,788

[45] Date of Patent: Sep. 7, 1993

[54] CABLE SASH INTERLOCK

[75] Inventor: Scott Buie, Statesville, N.C.

[73] Assignee: Kewaunee Scientific Corporation, Statesville, N.C.

[21] Appl. No.: 931,362

[22] Filed: Aug. 18, 1992

[51] Int. Cl.[5] ..... E05F 17/00

[52] U.S. Cl. ..... 49/95; 49/99; 49/445; 454/62

[58] Field of Search ..... 49/95, 99, 404, 445; 454/56, 62

[56] References Cited

U.S. PATENT DOCUMENTS

| | | | |
|---|---|---|---|
| 1,896,423 | 2/1933 | Ross | 49/95 |
| 2,014,329 | 9/1935 | Hellmann . | |
| 2,112,347 | 3/1938 | Ross | 49/95 X |
| 2,207,148 | 7/1940 | Hall | 49/95 X |
| 3,025,780 | 3/1962 | Russell . | |
| 3,726,206 | 4/1973 | Worick, Jr. . | |
| 3,934,496 | 1/1976 | Turko . | |
| 4,385,551 | 5/1983 | Zboralski . | |
| 4,548,128 | 10/1985 | Morikawa et al. | 454/56 |
| 4,829,887 | 5/1989 | Holschbach . | |

FOREIGN PATENT DOCUMENTS

| | | |
|---|---|---|
| 1174103 | 9/1984 | Canada . |
| 1174105 | 9/1984 | Canada . |
| 2061488 | 5/1981 | United Kingdom . |

*Primary Examiner*—Philip C. Kannan

*Attorney, Agent, or Firm*—Hill, Steadman & Simpson

[57] ABSTRACT

For a laboratory fume hood where two sashes are provided and the total open area through the sashes must be regulated, a counterweight system having a dedicated counterweight for each sash and having the respective counterweights connected together by a cross cable draped over pulleys arranged above each respective counterweight. The cross cable has a preselected length to have a selected length of slackness which is equivalent to the total aggregate regulated travel of either or both sashes. Thus, one sash can be opened 100% or two sashes can be opened 50%.

24 Claims, 2 Drawing Sheets

CABLE SASH INTERLOCK

BACKGROUND OF THE INVENTION

The present invention relates to a window sash interlock system for operating two windows in controlled fashion, and particularly to a fume hood sash interlock system for allowing operation of one sash while restricting the operation of a second sash.

When conducting experiments in a laboratory which may produce noxious vapors, gasses or dust or other irritants or harmful substances, it is common to locate these experiments within an enclosed cupboard or fume hood which is ventilated to a location exterior of the inhabited room. In practice, the fume hoods provide vertically sliding windows which can be raised to admit the laboratory technician's hands for manipulating the experiment or for placing the matter to be experimented on within the hood. It is also known that two sashes are placed side-by-side for two entryways into the hood or for two experiment stations. The sizing of sash openings is selected such that a minimum air velocity into the sash from the room during ventilation is maintained which is an important parameter to prevent infiltration of the experimental gas or other emission into the inhabited room.

Where more than one sash is provided it can be a problem that the total open sash area at any one time is greater than the design open area for minimum air velocity. That is, due to a plurality of ongoing experiments or for any other reason, more than one sash may be opened simultaneously. Because of this increased open area, the air entry velocity into the fume hood will drop to below minimum velocity and infiltration of noxious fumes or other matter into the inhabited room can occur. It is thus important to control or limit the total sash open area at any one time.

U.S. Pat. No. 4,385,551 to Zboralski and U.S. Pat. No. 4,829,887 to Holschbach disclose means where two side-by-side sashes cannot be open simultaneously due to the implementation of a flipping motion sash lock. Great Britain Patent 2,061,488 discloses a fume hood construction having four sashes with pairs connected by means of cables. Lifting or lowering of a sash affects the vertical position of a respective other sash connected thereto by the cable.

U.S. Pat. No. 3,726,206 to Worick, Jr. discloses a fume hood having three sash members connected together via a cable wrapped around a pulley, wherein movement of one sash member produces a corresponding movement of the other in an opposite direction, each sash member serving as a counterbalance for the other.

Canadian Patents 1,174,103 and 1,174,105 disclose horizontal sliding sash panels and dampers which are arranged to provide proper opening for auxiliary air. U.S. Pat. No. 3,934,496 to Turko discloses a counterbalance arrangement for a fume hood. U.S. Pat. No. 3,025,780 to Russel discloses side-by-side sashes for a laboratory fume hood wherein each sash is counterbalanced by a single counterweight connected to the respective sash by two cords.

SUMMARY OF THE INVENTION

The present invention provides an interlock system for multiple sashes serving a fume hood or laboratory cupboard. The sash interlock system allows partial operation of both sashes in an open condition as long as the total sash opening is not greater than one fully opened sash. The invention allows full operation of one sash with the respective other sash in a closed condition.

The sash interlock system provides that each sash has a counterweight arranged at a backside of the fume hood and connected via pulleys and cables to the respective sash. In a preferred embodiment, each sash is held by two cables which provides for smooth operation and a degree of redundancy concerning failure of any one cable. Additionally, a cross cable is provided which connects the respective counterweights together. The cross cable is arranged draped over a pulley overlying each respective counterweight. The cross cable is itself weighted at a central portion to keep the cross cable relatively taught when in a slack condition. This weight retains the cross cable properly on the pulleys and prevents entanglements.

The sash interlock operates as follows. The cross cable remains slack as long as both sashes are closed. When one sash is open, the corresponding sash counterweight lowers and reduces the slack in the cross cable. Once the sash has been fully opened, the counterweight has been lowered the maximum amount and no slack is present in the cross cable. With the one sash fully open, the other sash cannot be effectively opened since its counterweight cannot be lowered because the counterweights are connected. If one sash is only raised halfway, the second sash can also be raised halfway before the cross cable becomes tight. Once the cross cable becomes tight, neither counterweight can be lowered so neither sash can be easily opened or held open any further.

DETAILED DESCRIPTION OF THE PRESENTLY PREFERRED EMBODIMENTS

Figure 1:
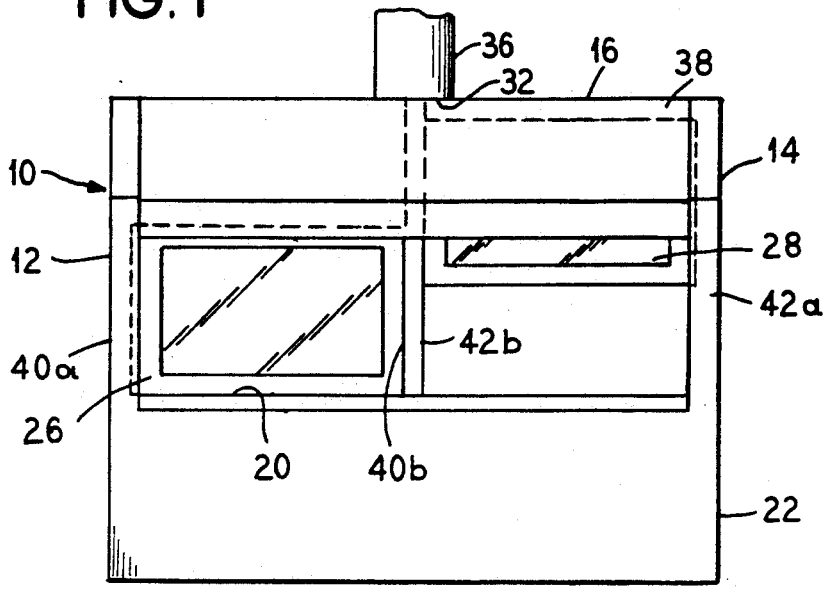
FIG. 1 is a front elevational view of a fume hood of the present invention.

FIG. 1 shows a fume hood or fume cupboard 10 comprising side walls 12, 14, top wall 16, counter top 20 and supporting stand 22 Which elevates the counter top 20 to an appropriate working level for the laboratory technician. A first window sash 26 is arranged side-by-side with a second window sash 28. The fume hood lo further provides a back wall 30 shown in FIG. 2. The fume hood 10 provides a top opening 32 which provides for ventilation air passage therethrough and onward to an exhaust stack or air treating equipment. Shown connected to the opening 32 is a stack 36. The first sash 26 and the second sash 28 are vertically slidable behind a top front panel 38, by riding in vertically arranged and laterally spaced apart tracks 40*a*, 40*b* and 42*a*, 42*b*.

Figure 2:
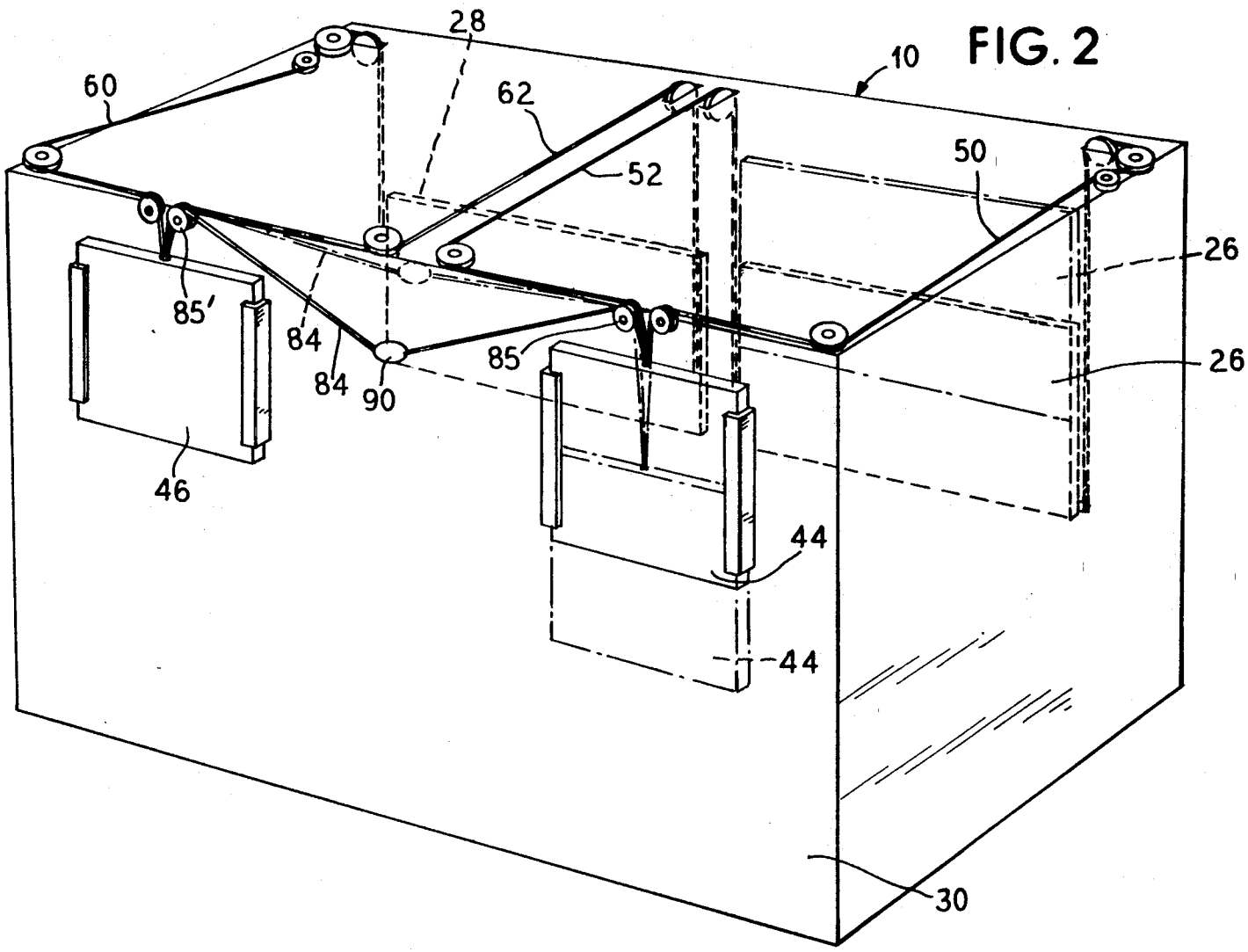
FIG. 2 is a rear perspective view of the fume hood of FIG. 1.

FIG. 2 shows a perspective view of the fume hood of FIG. 1. As will be more completely described with regard to FIG. 3, the fume hood 10 provides a counterweight 44 for the first sash 26, and a counterweight 46 for the second sash 28. The counterweight 44 is suspended by a first cable 50 and a second cable 52. The second counterweight 46 is suspended by a first cable 60 and a second cable 62.

Figure 3:
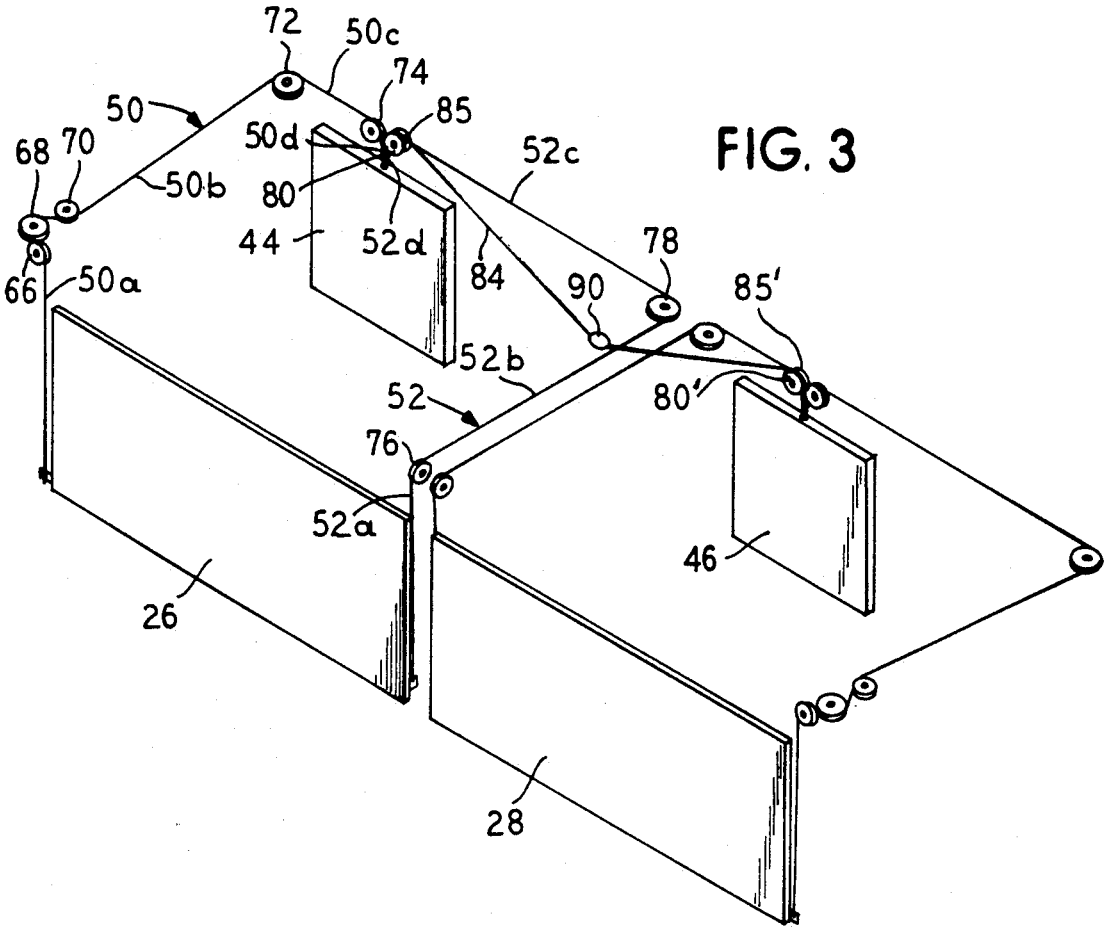
FIG. 3 is a perspective view of a sash counterweight system for the fume hood of FIG. 1.

FIG. 3 shows a sash and counterweight configuration for the two sashes 26, 28 arranged side-by-side. The configuration with respect to the first sash 26 and the first counterweight 44 is identical to a mirror image configuration of the second sash 28 and the second counterweight 46. Therefore, the pulley system and cable system for hanging the first counterweight 44 and supporting the first sash 26 will be explained with the understanding that the configuration for the second sash 28 and the second counterweight 46 is correspondingly the same. The first sash 26 is supported by the cable 50 at one lateral side and the cable 52 at a second lateral side. The cable 50 extends upward from the sash 26 to a grouping of three pulleys, a first pulley 66, a second pulley 68, and a third pulley 70. By coaction of the three pulleys a vertical raising of a leg 50*a* of the cable 50 is achieved by a horizontal translation of a leg 50*b* of the cable 50. A fourth pulley 72 is provided at a back corner of the fume hood 10 which translates a horizontal movement of the leg 50*b* into an offset horizontal movement of a leg 50*c*. A fifth pulley 74 is provided above the first counterweight 44 which translates the horizontal movement of the leg 50*c* to a vertical movement of a leg 50*d* of the cable 50. Thus, vertical movement of the leg 50*a* is transferred through pulleys to correspond to a vertical movement in the leg 50*d*. The second cable 52 is arranged upward from the first sash 26 to a sixth pulley 76 which transfers a vertical movement of a leg 52*a* of the second cable 52 to a horizontal movement in a leg 52*b*. The cable 52 next extends to a seventh pulley 78 which transfers a horizontal movement in the leg 52*b* to a horizontal offset movement in a leg 52*c*. An eighth pulley 80 is arranged above the counterweight 44 and transfers a horizontal movement of the leg 52*c* to a vertical movement of a leg 52*d* arranged between the eighth pulley 80 and the counterweight 44.

A cross cable 84 is provided between the first counterweight 44 and the second counterweight 46. The cross cable 84 is arranged draped over a ninth pulley 85 and a corresponding ninth pulley 85' of the second counterweight 46. The ninth pulley can be coaxially arranged with the eighth pulley 80 and the corresponding ninth pulley 85' can be coaxially arranged with a eighth pulley 80', i.e., the pulleys 85, 80 and 85', 80' can be pulleys which have two races, one race for the second cable 52, 62 and a second race for the cross cable 84. Alternatively, separate pulleys can be used for the cables 52, 62 and the cross cable respectively. A cross cable weight 90 is provided near mid-span of the cross cable 84 to keep the cross cable 84 relatively taught during periods where otherwise the cross cable 84 would be slack.

The solid line configuration shown in FIG. 2 represents the condition where both sashes 26, 28 are in a closed condition, i.e., closed as to admitting air into the fume hood 10. When the first sash, 26, for example, is raised as shown dashed, the counterweight 44 is lowered under the force of its own weight due to movement of the cables 50, 52. Lowering of the first counterweight 44, shown dashed, decreases the length of cross cable 84 between the second pulley 85 and the corresponding second pulley 85' and eventually draws the cross cable 84 taught as shown dashed. The cross cable weight 90 is shown elevated. In this condition, the first sash 26 is in a full open position. With the cross cable 84 thus drawn taught as shown dashed in FIG. 3, the second counterweight 46 cannot be lowered (without a raising of the first counterweight 44) due to lack of any slack in the cross cable 84. If the second counterweight 46 were to be forced downward, the first counterweight 44 would have to rise. Thus, it is understood that if the first sash 26 were only lifted halfway, a half portion of slack would be available in the cross cable 84 so that the second sash 28 could also be raised halfway.

If one sash is 100% open the respective other sash is not positively prevented from lifting, but the other sash will not be counterbalanced during lifting nor counterbalanced to stay open. This holds true also if, for example, one sash is open 50% and the other sash is attempted to be opened more than 50%, the amount in excess of 50% will not be effectively counterbalanced and will not be held open more than 50%.

In the illustrated embodiment, side-by-side sashes and counterweights are shown. However, the invention could be adapted for other configurations as well and is not limited to the illustrated embodiment.

Although the present invention has been described with reference to a specific embodiment, those of skill in the art will recognize that changes may be made thereto without departing from the scope and spirit of the invention as set forth in the appended claims.

I claim as my invention:

1. A counterweight system for controlling the opening of two sashes mounted in a housing, comprising:

a first sash;

a second sash;

a first counterweight;

a second counterweight;

means for coupling said first counterweight with said first sash to allow opposite vertical movement between said first counterweight and said first sash;

means for coupling said second counterweight with said second sash to allow opposite vertical movement between said second counterweight and said second sash;

means for operatively connecting said first counterweight to said second counterweight and for regulating aggregate downward vertical movement of said first and second counterweights.

2. The system according to claim 1, wherein said means for operatively connecting and regulating comprises a cross cable and a first cross cable pulley mounted to said housing above said first counterweight and a second cross cable pulley mounted to said housing above said second counterweight, said cross cable draped over said cross cable pulleys and connected at opposite ends to said first and second counterweights respectively, said cross cable having a preselected length to provide a selected slackness when said first sash and said second sash are closed.

3. The system according to claim 1, wherein said means for coupling said first sash to said first counterweight comprises a first cable connected to said first sash, and a first cable pulley arranged on a top of said housing, said first cable draped over said first cable pulley and connected to said first counterweight; and said means for coupling said second sash to said second counterweight comprises a second cable and a second cable pulley, said second cable connected to said second sash, said second cable pulley arranged on a top of said housing, said second cable draped over said second cable pulley and connected to said second counterweight.

4. The system according to claim 1, wherein said first sash and said second sash are arranged planarly side-by-side.

5. The system according to claim 1, wherein said means for operatively connecting and regulating comprises a cross cable and a first cross cable pulley mounted to said housing above said first counterweight and a second cross cable pulley mounted to said housing above said second counterweight, said cross cable draped over said first and second cross cable pulleys and connected to said first and second counterweights respectively, said cross cable having a predetermined amount of slack when said first and second sashes are closed, and a cross cable weight engaged to said cross cable and arranged between said first counterweight and said second counterweight.

6. The system according to claim 1, wherein said means for coupling said first sash to said first counterweight comprises:

a first cable;

a second cable;

a first cable pulley;

a second cable pulley;

said first cable and said second cable attached to said sash, spaced apart along a length of said sash, said first cable pulley and said second cable pulley arranged on said housing above said first counterweight, and said first cable and said second cable draped over said first cable pulley and said second cable pulley respectively and connected to said first counterweight.

7. An arrangement for limiting the total open window area of a laboratory fume hood having at least two sashes, comprising:

a first sash;

a second sash;

a first counterweight;

a second counterweight;

cable means for connecting said first sash to said first counterweight for counterbalancing the vertical raising and lowering of said first sash;

second cable means connecting said second sash to said second counterweight for counterbalancing the vertical raising and lowering of said second sash; and means for limiting the counterbalancing of said first and second counterweights to a preselected aggregate vertical range of said first and second counterweights.

8. The arrangement according to claim 7, wherein said means for limiting comprises a cable having a preselected length and a pulley means mounted to said fume hood and at least partially wrapped by said cable, said cable connected to said first and second counterweights, said preselected length having a select slackness when said first and second sashes are both lowered, allowing for said total aggregate vertical range of said first and second counterweights.

9. The arrangement according to claim 8, wherein said pulley means comprises a first pulley arranged above said first counterweight and a second pulley arranged above said second counterweight and said cable, when stretched taught, assumes an approximate horizontal section between said first pulley an said second pulley.

10. The arrangement according to claim 8, wherein said cable further comprises a cable weight arranged to maintain said slackness in a taught condition between said first counterweight and said second counterweight.

11. An arrangement for limiting the total open window area of a laboratory fume hood having two sashes, comprising:

a first sash;

a second sash;

a first counterweight;

a second counterweight;

a first cable connected to said first counterweight and to said first sash, said first cable supported by the fume hood along its length between said first counterweight and said first sash at a position elevated with respect to said first counterweight;

a second cable connected to said second counterweight and to said second sash, said second cable supported by the fume hood along its length between said second counterweight and said second sash at a position elevated with respect to said second counterweight; and a cross cable connected to said first counterweight and to said second counterweight and supported from the fume hood along its length between said first counterweight and said second counterweight at a position elevated from said first counterweight and said second counterweight.

12. An arrangement according to claim 11 further comprising a cross cable weight connected to said cross cable at approximately mid-length of said cross cable.

13. An arrangement according to claim 11, wherein said first sash and said second sash are arranged planarly side-by-side.

14. An arrangement according to claim 11, wherein said cross cable is supported by a first pulley supported by said fume hood and arranged above said first counterweight, and a second pulley supported by said fume hood and arranged above said second counterweight, said cross cable draped over said first pulley and said second pulley.

15. A counterweight system for controlling the opening of two sashes mounted in a housing, comprising:

a first sash;

a second sash;

a first counterweight;

a second counterweight;

a first cable connecting said first sash to said first counterweight and arranged to provide opposite vertical movement between said first sash and said first counterweight;

a second cable connecting said second sash to said second counterweight and arranged to provide opposite vertical movement between said second sash and said second counterweight; and a cross cable connected to said first counterweight and said second counterweight and arranged to provide opposite vertical movement between said first counterweight and said second counterweight.

16. A system according to claim 15 further comprising a cross cable weight connected to said cross cable at approximately mid-length of said cross cable.

17. A system according to claim 15, wherein said first cable is supported by said housing at a position along its length between said first sash and said first counterweight, said position elevated with respect to said first counterweight.

18. A system according to claim 15, wherein said cross cable is supported by said housing at a position along its length between said first counterweight and said second counterweight, said position elevated with respect to said first counterweight.

19. A system according to claim 15 further comprising a first pulley and a second pulley, said first pulley arranged above said first counterweight and supported from said housing, said second pulley arranged above said second counterweight and supported from said housing, said cross cable draped over said first and second pulleys and supported thereby.

20. A system according to claim 15, wherein said first sash and said second sash are arranged planarly side-by-side.

21. An arrangement for limiting the total effective open window area of a laboratory fume hood having at least two sashes, comprising:

a hood shell;

a first sash vertically slidably mounted to said shell for opening a first window in said shell;

a second sash vertically slidably mounted to said shell for opening a second window in said shell;

a first means for counterbalancing said first sash to assist in slidably raising said first sash;

a second means for counterbalancing said second sash to assist in slidably raising said second sash;

means for limiting said first means for counterbalancing and said second means for counterbalancing to a preselected aggregate raising of said first and second sashes.

22. The arrangement according to claim 21, wherein said preselected aggregate raising is equivalent to the lifted position exposing one fully open window of said first and second windows.

23. The arrangement according to claim 21, wherein said first and second means for counterbalancing each comprise a counter weight operatively connected to a respective sash by a cable, the cable partially wrapped on a pulley, the pulley mounted to the shell above the counterweight.

24. The arrangement of claim 23, wherein said means for limiting comprises a connection between said counterweights which allows only a limited vertical displacement between counterweights.

* * * * *